United States Patent [19]

Viebrantz

[11] Patent Number: 4,952,761

[45] Date of Patent: Aug. 28, 1990

[54] TOUCH CONTACT SWITCH

[75] Inventor: Hans-Joachim Viebrantz, Bad Neustadt/Saale, Fed. Rep. of Germany

[73] Assignee: Preh-Werke GmbH & Co. KG, Saale, Fed. Rep. of Germany

[21] Appl. No.: 327,997

[22] Filed: Mar. 23, 1989

[30] Foreign Application Priority Data

Mar. 23, 1988 [DE] Fed. Rep. of Germany ..... 3809770

[51] Int. Cl.[5] ..... H01H 13/52

[52] U.S. Cl. ..... 200/513; 200/43.01

[58] Field of Search ..... 200/513, 517, 512, 5 A, 200/43.01

[56] References Cited

U.S. PATENT DOCUMENTS

| | | | |
|---|---|---|---|
| 4,390,765 | 6/1983 | Sado et al. | 200/513 |
| 4,677,268 | 6/1987 | Nemeth et al. | 200/513 |

FOREIGN PATENT DOCUMENTS

| | | | |
|---|---|---|---|
| 0120667 | 3/1984 | European Pat. Off. | 200/513 |
| 0091284 | 12/1987 | European Pat. Off. . | |
| 0280491 | 2/1988 | European Pat. Off. . | |
| 3222747 | 12/1983 | Fed. Rep. of Germany . | |
| 3340575 | 5/1984 | Fed. Rep. of Germany . | |
| 2112577 | 7/1983 | United Kingdom | 200/513 |

*Primary Examiner*—Renee S. Luebke

*Attorney, Agent, or Firm*—Wegner & Bretschneider

[57] ABSTRACT

A touch contact switch having a plane contact arrangement has a cover of elastic material covering the contact arrangement. Contacting in the contacting arrangement takes place only after a deliberate force P' has been applied which causes a partial surface in the switch to arch in the direction of operation of the switch and to cause contacting in the contacting arrangement.

8 Claims, 2 Drawing Sheets

TOUCH CONTACT SWITCH

BACKGROUND OF THE INVENTION

The invention relates to a touch contact switch with a plane contact arrangement consisting of a fixed contact and a movable counter contact contacting the fixed contact upon operation of the touch contact switch, and of a cover of elastic, rubber-like material vaulting the contact arrangement and comprising an operating member which is fixed elastically at a distance from the contact arrangement and passes this distance by a clearly recognizable stroke H upon operation of the touch contact switch by the force P and which effects the contacting of the contact arrangement by a partial surface of its inner side after the stroke has been completed.

Such touch contact switches, arranged separately or multiply beside each other forming a keyboard, are, in addition, usually surrounded by a casing. Sometimes a key cap is located above the operating member. The cover may be formed as a mat, especially with keyboards. Touch contact switches are used within printed circuits, for example, or with input keyboards for electronic systems such as calculators or manual transmitters of remote control devices. Touch contact switches have an installed, clearly recognizable height of stroke, in general between 1 and 4 mm.

Such a touch contact switch with a snap effect in the stroke is known from West German laid open application No. 33 40 575. FIG. 5 and FIG. 6 thereof show ribs which limit the further stroke after the contacting has taken place.

U.S. Pat. No. 4,390,765, too, shows a touch contact switch with snap effect. In particular, it proposes means for increasing the key stroke length until the desired snap effect has been achieved. A considerable part of the total stroke remains as rest stroke until the contacting.

In order to achieve a contact with satisfying feel, according to West German laid open application No. 32 22 747, the inclination of the movable contact is to be avoided by supporting members. The supporting members are to be of smaller height than than the movable contact. They become effective only after the contacting has taken place.

A disadvantage of the known touch contact switches is that they cause contact to take place after an installed restoring force has already been overcome. Thus, there is the danger of malfunctions due to subjects resting on the touch contact switch, for example, and battery energy is consumed unnecessarily.

SUMMARY OF THE INVENTION

It is therefore an object of the invention to improve the known touch contact switch such that the contacting at the end of the stroke cannot take place incidentally after an installed restoring force has been overcome and a clearly recognizable stroke has been passed, but, instead, only as the effect of a deliberate measure.

In order to achieve this object the invention suggests that the stroke of the operating member caused by an operating force be limited—without effecting a contacting —by supporting surfaces which are arranged peripherally to the partial surface and protrude thereover, and that an additional operating force acting centrally upon the operating member arches the partial surface in the operating direction in order to effect a contacting.

This solution provides advantageously for a simple, space-saving protection against incidental contacting. This can be especially favourable with small, portable devices such as manual transmitters of remote control devices. Because of their small size such manual transmitters are covered with light material, e.g. paper, and, without the invention, a subject placed thereon, e.g. a book, may inadvertently operate one or several touch contact switches of the covered manual transmitter by its weight. This means that the energy of the battery is consumed and that, finally, the transmitter cannot operate anymore. With water-proof manual transmitters equipped with the invention only the water pressure of greater depth will manage to press the touch contact switch and to cause a contacting; in private use, for example in the bath tub or in the swimming pool, such depths are not reached so that a contacting is impossible. With manual transmitters lacking the invention a contacting would take place even with such small depths.

In case of need the supporting surfaces may be arranged separately as single surfaces around the partial surface, they may be arranged concentrically and, if necessary, form a concentric ring.

If the partial surface itself is electrically conducting, it may replace the movable counter contact and function as switching bridge for two fixed contacts arranged beside each other. For such a contact arrangement the arrangement of the strip conductors and contact surfaces on only one side of the substrate is sufficient.

It has turned out that the "book protection" is already sufficient if the supporting surfaces protrude over the partial surface by about 2% to about 10%, more preferably by about 4% of the diameter of the partial surface. With usual dimensions and materials the deliberately applied operating force P' is then only insignificantly higher than the force P effecting the stroke.

In the following the invention is explained by means of drawings.

DETAILED DESCRIPTION OF THE INVENTION

Figure 1:
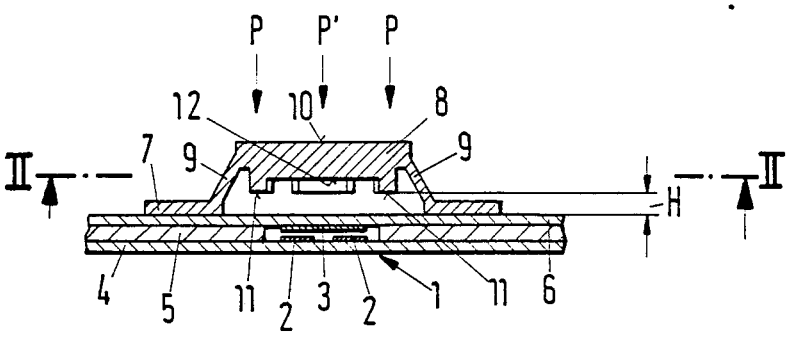
FIG. 1 shows a sectional view of a touch contact switch.
Figure 2:
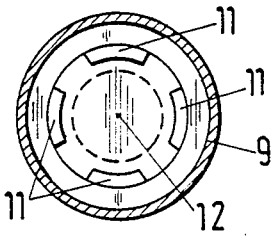
FIG. 2 shows a sectional view of the touch contact according to FIG. 1 along line II—II.

The touch contact switch according to FIG. 1 comprises a plane contact arrangement 1 with plane contacts 2, 3. A substrate 4 supports two fixed contacts 2; the connecting strip conductors are not shown. On the substrate 4 there is a spacer 5 cut free in the area of the contact arrangement 1. It is followed by an elastic support foil 6 with a counter contact 3 located at a distance opposite the fixed contacts 2. The contact arrangement 1 is vaulted by a cover 7 of elastic, rubber-like material, supported by the support foil 6. Forming a part of the cover 7, the operating member 8 is located above and aligned with the contact arrangement 1. The operating member 8 is fixed elastically at a distance from the contact arrangement 1 by means of the wall sections 9 of the cover 7. Under the effect of an operating force P acting in the direction of arrows upon the plane touching surface 10 on the upper side of the operating member 8 the operating member 8 sinks onto the support foil 6, overcoming the restoring force of the elastic wall sections 9 and passing a clearly recognizable key stroke H. The key stroke H is limited by supporting surfaces 11 protruding in stroke direction at the inner side of the operating member 8 and rising on the support foil 6 outside the contact arrangement 1 without effecting a contacting in the contact arrangement 1. The supporting surfaces 11 protrude over the partial surface 12 located in the center of the underside of the operating member 8 (FIG. 2), the partial surface 12 being provided for effecting the contacting in the contact arrangement 1 so that even an increase in the operating force P generating the stroke H does not lead to a contacting. Upon application of an additional operating force P', a deliberate measure acting only in the central part of touching surface 10, the partial surface 12 will arch beyond the level of the supporting surfaces 11 and effect a contacting of the contacts 2, 3.

The size of the additional operating force P' depends, for example, on the elasticity of the operating member 8 or on the distance of the supporting surface 11 from the partial surface 12 referring to the diameter of the arrangement of supporting surfaces. The additional operating force P' may be part of the force applied by the user which triggers off stroke H.

Figure 3:
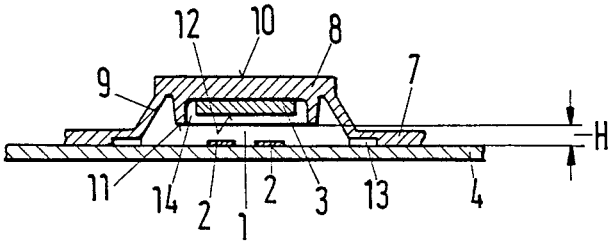
FIG. 3 shows a sectional view of another touch contact switch along line III—III in FIG. 6.
Figure 4:
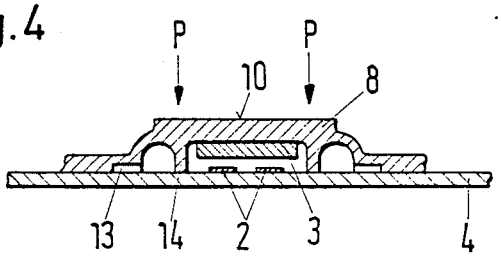
FIG. 4 shows the touch contact switch of FIG. 3 when the force P is effective.
Figure 5:
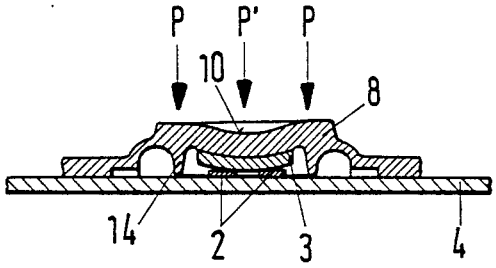
FIG. 5 shows the touch contact switch of FIG. 4 when the force P' is effective.

FIGS. 3, 4 and 5 show another touch contact switch simplified in comparison with that of FIG. 1 and explain its operation. Supporting surface 11 is formed by an elevated ring 14 positioned concentrically to the partial surface 12. The partial surface 12 is at the same time the contact surface of the counter contact 3 and connected with the insulating operating member by means of vulcanization, for example.

The starting position of the touching contact is shown in FIG. 3. In FIG. 4 the operating member 8 has sunk by the distance of the stroke H under the effect of the operating force P; the operating member 8 rests with ring 14 on substrate 4. In FIG. 5 the partial surface 12 of the counter contact 3 arches under the effect of the additional operating force P' acting upon the central part of the touching surface 10 in the direction of the fixed contacts 2, closing said contacts. Upon the cessation of the operating forces P, P' the operating member 8 is reset into the starting position (FIG. 3) by means of the elastic wall sections 9; the contacting is finished.

Figure 6:
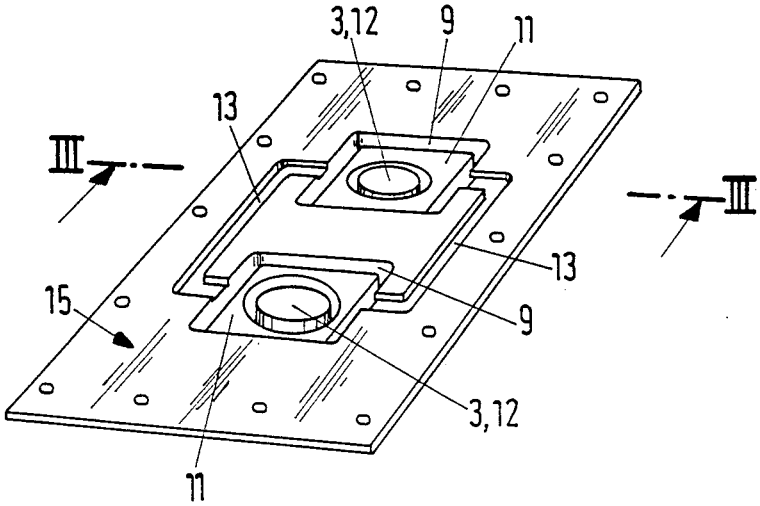
FIG. 6 shows a perspective view of the underside of a cover formed as a contact mat.

FIG. 6 shows a cover 7 for two touch contact switches also referred to as contact mat 15. The contact mat 15 comprises air channels 13 admitting an air flow when the air within a touch contact switch has been compressed by operating the operating member 8.

What is claimed is:

1. A touch contact switch comprising:

a planar contact mechanism including a fixed contact and a movable counter contact, said movable counter contact contacting the fixed contact upon actuation of the touch contact switch;

an elastic cover covering said contact mechanism;

an operating member which is fixed elastically at a distance from said contact mechanism, said operating member travelling a distance in an operating direction with a clearly recognizable stroke H upon actuation of the touch contact switch by a force P, the operating member including a partial surface formed in a central portion on an inner side of the operating member, said partial surface effecting contact with the contact mechanism; and a stroke limiting means for limiting the stroke H of the operating member caused by the force P to prevent inadvertent actuation of the touch contact switch, said stroke limiting means including at least one supporting surface disposed along the periphery of said partial surface and protruding downwardly therefrom, wherein an additional force P' acting upon the central portion of the operating member causes the partial surface to arch in the contacting direction to overcome the stroke limiting means and effect contact between the movable counter contact and the fixed contact.

2. The touch contact switch according to claim 1, wherein the partial surface is round and the supporting surfaces are arranged concentrically to the partial surface.

3. The touch contact switch according to claim 2, wherein the supporting surfaces form a concentric ring.

4. The touch contact switch according to claims 1, 2 or 3, wherein the partial surface is electrically conducting.

5. The touch contact switch according to claims 1, 2 or 3, wherein the supporting surfaces protrude over the partial surface by about 2% to about 10% of the diametrical distance of the partial surface.

6. The touch contact switch according to claims 1, 2 or 3, wherein the supporting surfaces protrude over the partial surface by about 4% of the diametrical distance of the partial surface.

7. The touch contact switch according to claim 4, wherein the supporting surfaces protrude over the partial surface by about 2% to about 10% of the diametrical distance of the partial surface.

8. The touch contact switch according to claim 4, wherein the supporting surfaces protrude over the partial surface by about 4% of the diametrical distance of the partial surface.

* * * * *